United States Patent [19]

Zimmerman et al.

[11] Patent Number: 4,947,676

[45] Date of Patent: Aug. 14, 1990

[54] PNEUMATIC BALL DROP CHECKER DEVICE AND METHOD

[76] Inventors: Larry Zimmerman, Rte. 1, Box 252, Alton, Ill. 62002; John Miller, P.O. Box 115, Hecker, Ill. 62248

[21] Appl. No.: 331,738

[22] Filed: Apr. 3, 1989

[51] Int. Cl.[5] ..... G01B 13/00

[52] U.S. Cl. ..... 73/37.5; 73/37

[58] Field of Search ..... 73/37, 37.5; 33/DIG. 2; 141/94

[56] References Cited

U.S. PATENT DOCUMENTS

| | | | |
|---|---|---|---|
| 3,893,493 | 1/1975 | Foirest et al. | 141/47 |
| 3,995,666 | 12/1976 | Michaels | 141/3 |
| 4,582,102 | 4/1986 | Rieser | 141/95 |

*Primary Examiner*—Hezron E. Williams
*Attorney, Agent, or Firm*—Don W. Weber

[57] ABSTRACT

A pneumatic sensing device is presented which automatically senses the motion of a ball falling into a can. A sensing arm protrudes into the pathway of the dropping ball. When the ball hits one end of the arm, the other end of the arm rotates upward and closes off an exhaust port, creating a back pressure in a proximity switch. The proximity switch then sends a pneumatic signal to a four-way valve that allows the now filled can to move on to the next work station. Also presented is a method of using the sensing arm which uses a regulator and indicator to display when the ball drop station has been energized but the ball has failed to drop.

6 Claims, 3 Drawing Sheets

PNEUMATIC BALL DROP CHECKER DEVICE AND METHOD

BACKGROUND OF THE INVENTION

This invention relates to the field of filling aerosol spray paint cans or similar items. When an aerosol spray paint can is charged, it is necessary to place a ball inside the can. This ball permits the user to stir the contents of the can by shaking the can with the ball inside.

Aerosol spray paint cans and the like are normally filled and sealed by automatic mass production. A conveyor belt type arrangement is used whereby the cans are placed on a conveyor belt which has placer tabs for each can and receive charges of contents. The cans are eventually crimped and sealed for transportation and sale. During this charging process it is necessary for the manufacturer to insert a ball inside of each can. Should a ball fail to be inserted in the can the finished product would not be marketable. It is therefore important in the industry to insure that each can receives a ball before the can is sealed.

Other manufacturing processes also require that balls be inserted into a can before it is permanently sealed. Any industry which utilizes a ball inside of a sealed container would benefit from this device and the method for using same.

One major problem which exists in automatically checking the insertion of a ball into a can is that the spray paint industry (and other related industries) use highly volatile chemicals in filling the contents of the can prior to the insertion of the ball. For example, in the spray paint industry, acetone and methyl chloride must be placed into the can before it is sealed. Both of these chemicals are highly volatile and the use of electrically powered checking devices is severely restricted and quite hazardous.

It is an object of this invention to provide an automatic ball drop checking device which utilizes only pneumatic sensing devices and pneumatic power for its operation. The use of air pressure rather than electricity greatly enhances the safety of the instant automatic checking device.

It is another object of this invention to provide a method which may be universally adapted for use in counting materials when electronic counters or other electronic devices would be impractical or hazardous.

BRIEF SUMMARY OF THE INVENTION

In the aerosol spray paint can industry, and related industries, an assembly line is utilized to charge the contents of the aerosol can with the appropriate fluids. Once the cans have been filled, a ball is inserted into the can and the can is then crimped and sealed. A series of dispensing nozzles and apparatus are applied to each can as the filling and sealing operations progress. The cans ride on a conveyor belt and an indexing system forwards each can to the next station as the operation in the previous station is completed. A crucial part of this operation involves dropping a ball from a ball drop plate into each can in turn.

The instant device relates to an automatic means for determining when a ball has been inserted into a can. The device incorporates a unique checker arm for controlling a proximity switch sensor. The proximity switch sensor works on pneumatic air pressure.

The device comprises an essentially rectangular base having two holes in the top. A first hole is used to bolt the entire device to the appropriate position in the automated line. A second and larger hole is provided for receiving the drop tube. A drop tube with an essentially cylindrical inner diameter is attached perpendicularly to the base. The drop tube has a small slot in the side of it.

Next to the drop tube and perpendicularly attached to the bottom of the base is an essentially L-shaped bracket. Pivotably attached to the short arm of the L is a sensor arm which protrudes slightly into the inner cylinder of the drop tube. In the long portion of the L-shaped bracket is a void which consists of the proximity switch sensor outlet. When a ball is dropped down the drop tube it will contact the protruding part of the sensor arm thus rotating the protruding part of the arm downward and the opposite end of the sensor arm upward. This upward motion of the sensor arm blocks the proximity switch sensor port thus creating a back pressure to the sensor switch. When that occurs a signal is sent through a fluid amplifier indicating that the ball has dropped and the various mechanisms required to activate the movement of the conveyor belt so that the cans move to the next station occurs.

The new method for using this device comprises supplying a signal to a four-way valve which locks down a Humphrey valve and simultaneously sends a signal to an indicator and regulator. The regulator reduces the line pressure to 5–10 pounds per square inch and supplies pressure to the proximity switch sensor. When a ball drops past the sensor arm a back pressure is created in the proximity switch sensor. That signal is then amplified and sent back to the four-way valve to open the Humphrey lock-out valve and indicate that a ball has dropped, moving the can to the next station.

Since it is impossible for a ball to drop through to a can without activating the sensor arm, the device is very reliable. Because the entire device operates on a mechanical signal (the ball dropping) which is then converted into an air pressure signal through various regulators and sensing devices, the operation is simple, inexpensive, and highly reliable.

BRIEF DESCRIPTION OF THE DRAWINGS

FIG. 1 is the most representative figure of the device.

DETAILED DESCRIPTION OF THE PREFERRED EMBODIMENT

In the assembly line manufacture of aerosol paint cans, or related articles, an inner lock valve is located on the drive cylinder to a chain driven continuous belt. At the end of each indexed stroke, each can is moved forward to the next station to receive more fluid, to receive a ball, to be sealed, or to have various functions performed upon the article. At the end of each indexed stroke, the inner lock valve sends a pulse of air to the track switch on the supply line. Simultaneously, a signal is sent to the four-way control valve on the drive cylinder. This signal is then routed through a Humphrey inter-lock valve at each station to insure that each station has fired before the four-way control valve on the drive has a chance to reverse the drive cylinder and release the inner-lock valve on the drive which would de-energize the track switch supply line.

Figure 5:
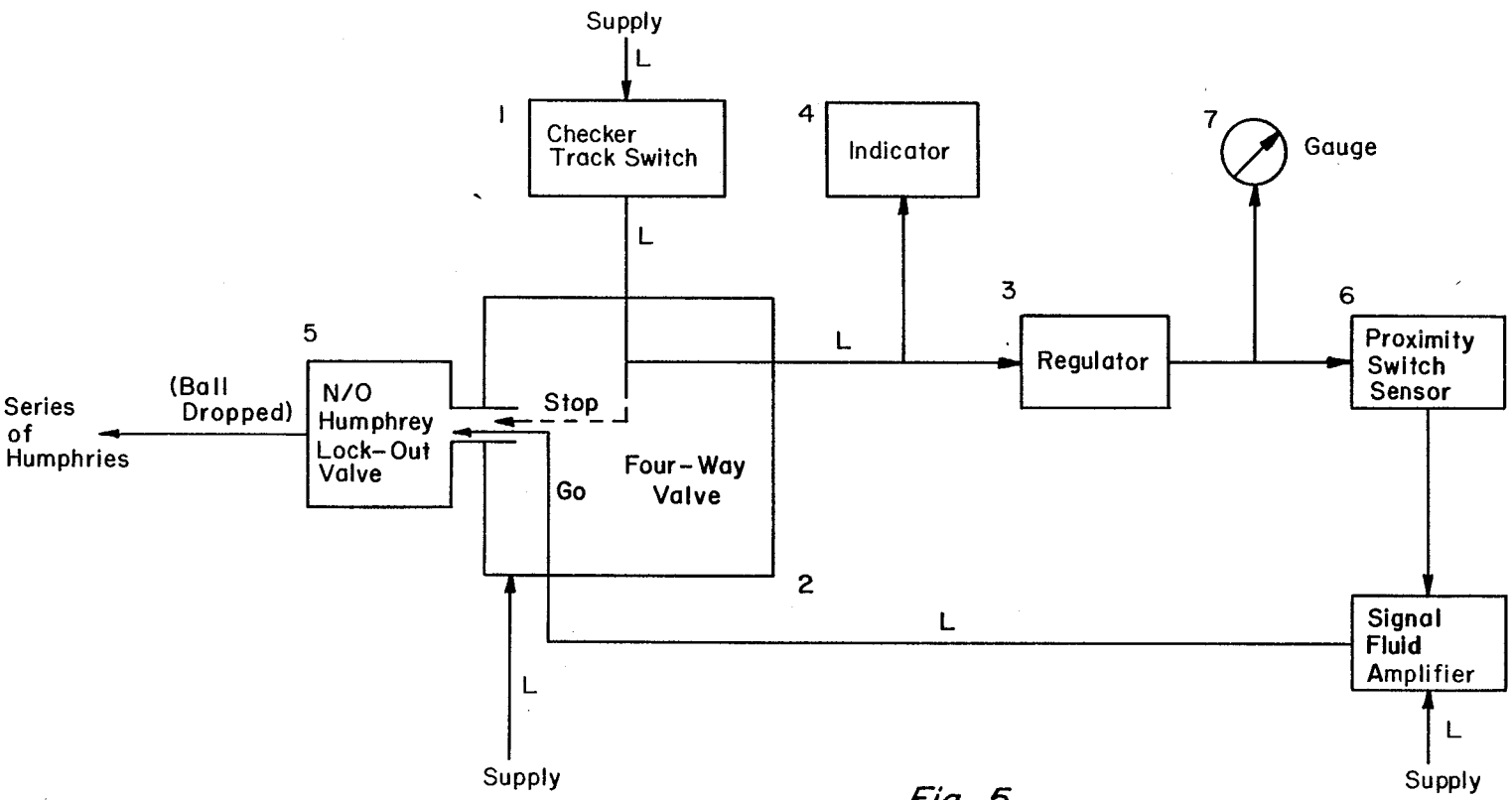
FIG. 5 is a schematic diagram showing the various paths of the air pressure and the devices which are used to practice the method of this invention.

In the operation of this device, as shown schematically in FIG. 5, the track switch supply line is energized to signify that the ball drop station is ready to accomplish its function, which is to drop a ball down a drop cylinder and into a can. Since the Humphrey lock-out valve on the ball drop circuit is in the normally open position it is necessary for the checker track switch to send a signal to the Humphrey lock-out valve to close simultaneously with sending a signal to the ball drop circuit to drop a ball. With the checker track switch 1 supply line energized and the station on-off valve in the "on" position and with a container in place to actuate the track switch, the track switch sends an air signal to the pilot of the four-way control valve for the ball feed. Simultaneously through a tee in the pilot air feed line a signal is sent to the pilot of the four-way valve 2 for the ball feed drop checker for the ball drop circuit. The four-way valve used herein is standard in the industry and may be purchased, for example from LHB Industries, part #152-JJ-4150. The four-way control valve 2 for the ball feed drop circuit then shifts, feeding supply air to the input of the regulator 3 (LHB part # MAR-1) which is mounted on the ball drop checker control panel. Simultaneously through a tee, a signal is sent to a pressure indicator 4 (LHB part # IND-3-RD) which is also mounted in the control panel. The pressure indicator shows that the ball drop circuit has been energized. When the initial signal from the checker track switch 1 is fed into the four-way valve 2 it also shifts the Humphrey inner-lock valve 5 which is located on the four-way manifold. The normally open Humphrey inner-lock valve is then closed blocking the supply air to the pilot on the drive indexing control valve. This mode for the Humphrey lock out valve is shown schematically on FIG. 5 as "stop."

In actual production and charging of aerosol spray paint cans or the like, a series of HumphreY inner-look valves control the entire indexing of the drive cylinder and drive chain. Each station at which a function is performed has a Humphrey inner-lock valve. These inner-lock valves are connected in series so that any station not completing its cycle will block supply air to the indexing drive pilot on the indexing chain and keep the chain from advancing the cans to the next cycle. In the particular field involving aerosol spray paint cans, nine separate stations are involved. Nine functions are thus performed. The instant device deals with the station concerning the ball drop checker. Other mechanisms which would be used in conjunction with this device include a ball drop plate rotator, toluene filling head, acetone filling head, paint head, methyl chloride head, crimping the valve in the can, checking to insure that a vacuum is maintained in the can, and charging heads. A vacuum is commonly measured in inches of mercury drawn. The vacuum drawn by the crimping procedure should measure at least five (5) inches of mercury The charging heads only fill half the can at one station, the other half at a separate station. Should all of these functions be satisfactorily performed, all Humphrey lock-out valves (which are connected in series) would be open and an output signal to the four-way valve on the drive cylinder would index the drive chain and advance the cans. In standard operation, these stations are in pairs so that two cans may receive each operation simultaneously. The drive belt would then advance the cans two stations to receive the next operation.

Referring back to FIG. 5, it can be seen that the signal from the four-way valve (which is at a line pressure of approximately 60 pounds per square inch) activates the indicator 4 and is fed into the regulator 3. The regulator then reduces the pressure to 5–10 pounds per square inch in order to operate the proximity switch sensor (LHB #1022). In practice it has been found that the preferred pressure is between five (5) and ten (10) pounds to give the desired reliability for the proximity switch sensor 6. A tee in the signal line between the regulator and proximity switch sensor feeds gauge 7 so that the pressure to the sensor switch may be monitored. This proximity switch sensor 6 is mounted on the ball feed drop checker as shown in FIG. 1.

As the four-way valve 2 for the ball drop circuit shifts, a four-way valve for the ball drop plate rotator also shifts so that the Humphrey inner-lock on the ball drop plate rotator is in the closed position. The ball drop plate rotator receives supply air from its four-way valve which enters the air cylinder through the speed control valve on the ball drop plate rotator. That cylinder then moves forward turning the ball feeder disc or ball drop plate rotator which drops a ball into the ball feed drop tube 8. As the cylinder for the ball drop plate rotator reaches the end of its forward stroke, it contacts a station return valve which sends a signal to the opposite pilot on its four-way control valve shifting it and the inner-lock valve back to their normal position and allowing the air to be exhausted from the cylinder, at which point the spring in the cylinder returns it to its ready position.

Figure 1:
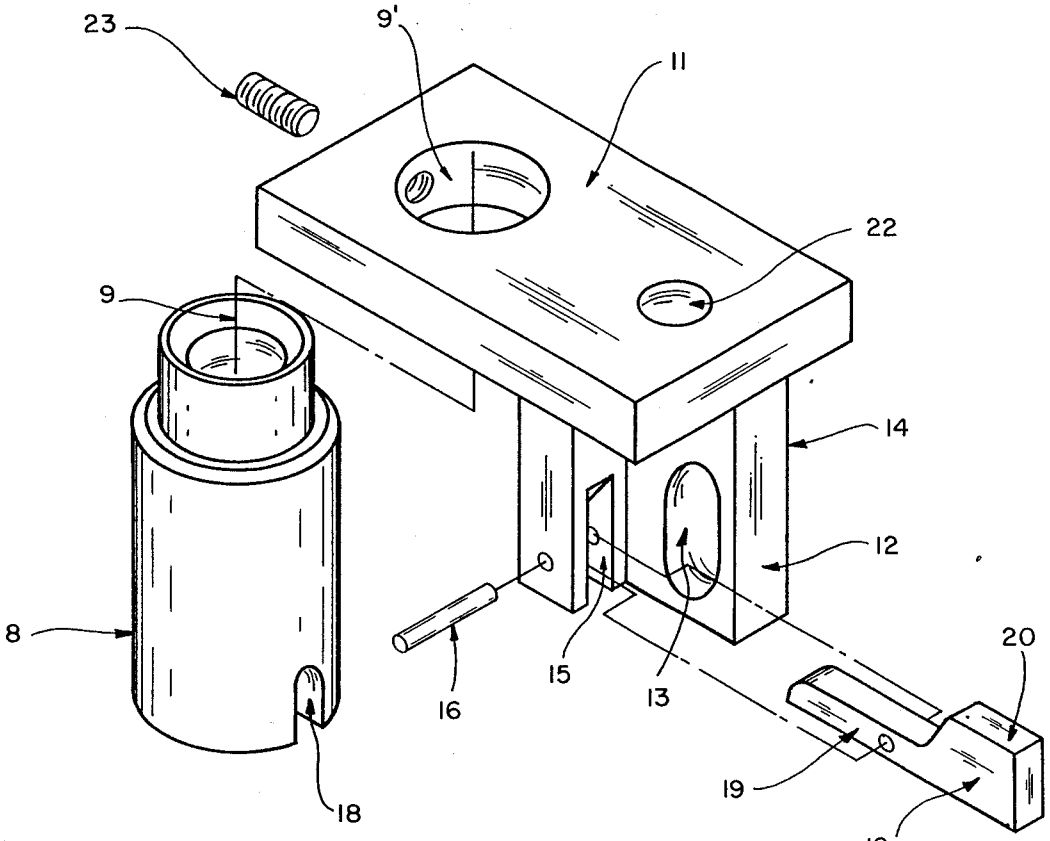
FIG. 1 is a perspective exploded view of the device.

As a ball drops through the ball drop tube 8 it contacts the drop checker sensor arm 10 (FIG. 1). The ball drop tube 8 is inserted into the large hole 9' on the sensor base 11 so that the inner cylindrical passage center 9 for the ball located within the ball drop tube 8 is perpendicular to the sensor base 11.

Also attached to the bottom of the sensor base is an essentially L-shaped bracket 12. This L-shaped bracket is attached to the bottom of the sensor base 11 and is perpendicular thereto. The long portion of the L-shaped bracket has a port 13 cut therethrough. To the far side 14 of this port is attached the proximity switch sensor device. The port 13 thus communicates with the proximity switch sensor 6.

Figure 2:
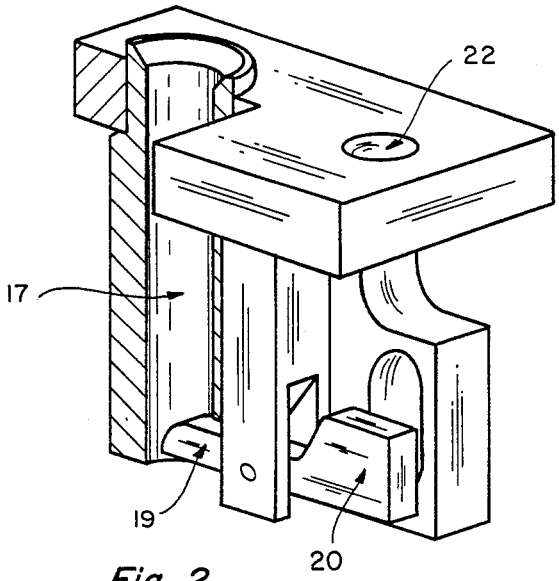
FIG. 2 is a perspective view of the device as assembled with the drop tube section cut away.
Figure 3:
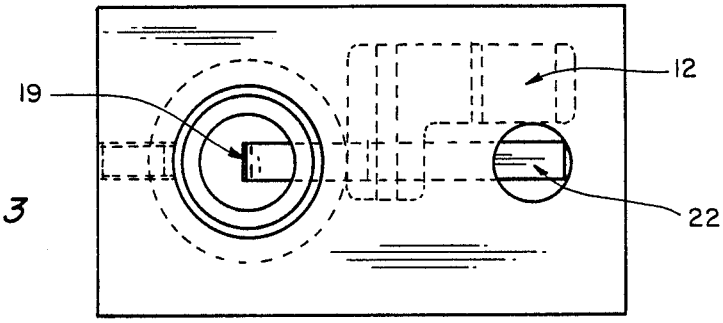
FIG. 3 is a top view of the device showing the drop tube, sensor bracket, and sensor arm protruding into the drop ball cylinder.
Figure 4:
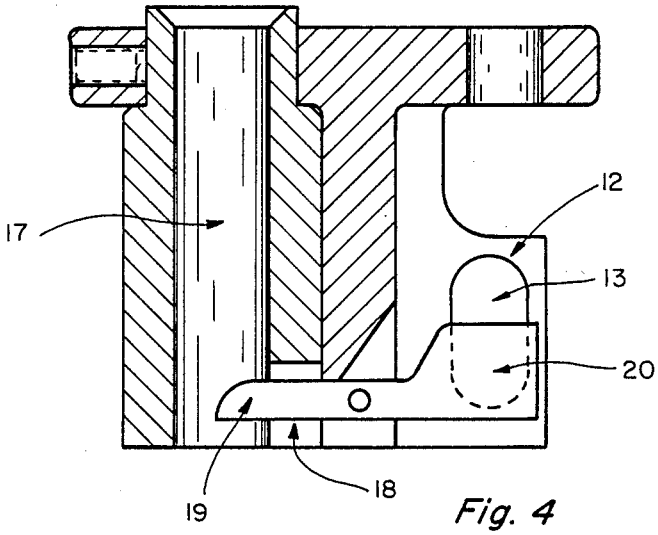
FIG. 4 is a front cut away view of the device showing particularly the inner cylinder of the drop tube.

To the short side of the L-shaped bracket is pivotably attached a sensor arm 10. The short side of the L-shaped bracket has an essentially rectangular slot 15 cut therein. The sensor arm 10 is pivotably attached in the sensor arm slot 15 by means of a pin 16. When the device is assembled, as best shown in FIGS. 2, 3 and 4, the sensor arm protrudes into the inner diameter of the drop tube 8. This inner diameter or ball cylinder 17 is the passageway which guides the ball from the ball drop plate rotator to the can. In order to allow the sensor arm 10 to rotate about its pivot pin 16, a ball drop slot 18 is cut into the ball drop tube 8. When appropriately assembled, as shown in FIGS. 2 and 4, it can be seen that one end 19 of the sensor arm protrudes inwardly into the center of the drop tube cylinder 17. The outward end 20 of the sensor arm 10 extends past the proximity switch mounting port 13.

In operation, when it is desired to drop a ball into a can, the ball drop plate rotator dispenses a ball through the hole in the base of the device. The ball then drops down through the inner cylindrical passage for the ball 9 and down the inner ball cylinder 17. As it contacts the inner end 19 of the sensor arm near the bottom of the cylinder, the sensor arm pivots allowing the ball to fall past it and into the container. (The sensor arm may be located anywhere along the length of the drop tube.) As the inner arm moves downward with the force of the dropping ball, the outer end 20 of the sensing arm moves upward to pass in front of the energized proximity switch exhaust port 13. In the preferred embodiment, the sensing arm is adjusted to provide approximately 1/16" of clearance between the proximity switch port base and the body of the pivot arm. As the arm passes in front of the proximity switch port, the exhaust port of the proximity switch is closed thus creating a back pressure and energizing the output of the proximity switch. Output air from the proximity switch is then fed to the signal input of the fluid amplifier valve 21 (see FIG. 5). The fluid amplifier valve (LHB #2010) is located on the control panel.

Once the ball has been dropped and sensed by the sensor arm and proximity switch sensor, the fluid amplifier amplifies the five (5) to ten (10) pounds per square inch signal from the proximity switch sensor and sends line pressure to the four-way valve 2. The signal fluid amplifier 21 has line pressure supplied to it by a line air input from a separate air supply line on the filling table. When a signal is supplied by the proximity switch sensor 6 to the input of the fluid amplifier valve, it energizes the output. This energized output air feeds the opposite pilot on the ball drop station four-way control valve 2. This control valve thus shifts its inter-lock valve (Humphrey lock-out valve 5) to its normal position and then de-energizes the ball drop checker proximity switch and fluid amplifier valve. Once the signal fluid amplifier 21 sends a signal through the four-way valve 2 to the Humphrey lock-out valve to return to its normally "on" position (symbolized by "GO" on the schematic) the inter-lock air signal continues through the remaining inner-lock stations through a series of Humphrey valves and ultimately reaches the drive pilot which causes the line to index and begin another cycle.

In the event that the ball feed station cycles but fails to drop a ball (due to a jam or an empty hopper) the ball drop checker indicator and gauge will both show the energized condition and the inter-lock will prevent the line from indexing to the next cycle. After the problem has been resolved, the ball feed can be manually operated. Once a ball drops, the ball drop checker will clear and the line will resume the normal indexing cycle.

This entire device may be attached in the appropriate manner to the automated assembly line process by means of the bolt hole 22. Alternatively, the bolt hole may be eliminated and the device may be attached by means of brackets or other standard and ordinary methods of attachment. In order to insure easy inspection and repair of the device, both the sensor arm and drop tube are made so that they may be removed by means of removing the holding pins (16 and 23). The ball drop tube 8 is held in place by means of the set pin 23; the sensing arm by pin 16.

While the preferred embodiment has been described herein, it can be seen that minor variations or equivalent interchange of parts may be used in order to practice this invention. While parts listed from LHB Industries have been drawn, any parts which function equivalently are acceptable. It is believed that the use of pneumatic air pressure rather than any electronic or electrical devices greatly enhances the safety and reliability of the counting devices. It is to be appreciated that the instant invention encompasses not only the embodiment of the sensor arm bracket and mechanism but also the method of practicing the use of this device in that the unique pneumatic air sensing mechanism is new and novel.

Having fully disclosed the preferred embodiment of the invention herein, we claim:

1. A pneumatic sensing device comprising:

(a) a base having a drop tube receiving hole therein for receiving the top of a drop tube;

(b) a drop tube having a cylindrical inner shaft, the top of said drop tube being attached to said base at said receiving hole and the bottom of said drop tube having a first slot therein;

(c) an essentially L-shaped sensor bracket perpendicularly attached to the bottom of said base, the long leg of said bracket having a proximity switch port therein and the short leg of said bracket having a sensor arm pivotably attached thereto;

(d) a means for attaching said sensing device to a work place;

(e) a means for pneumatically sensing rotation of the sensor arm.

2. A pneumatic sensing device as in claim 1 wherein said drop tube and sensing arm are detachably connected to said base and sensor bracket.

3. A pneumatic sensing device as in claim 1, wherein the means for attaching said device to a work place comprises a second attaching hole in said base for receiving an attaching bolt.

4. A pneumatic method for sensing movement of an article, comprising the steps of:

(*a*) supplying a signal to a first pilot on a four-way valve which closes a normally open Humphrey valve and simultaneously sends a signal to an indicator and regulator;

(*b*) indicating the presence of a signal from said four-way valve;

(*c*) regulating said signal to produce less than line pressure in a proximity switch sensor;

(*d*) mechanically sensing movement of an article so as to create a back pressure signal in said proximity switch sensor;

(*e*) amplifying said back pressure signal and sending it on to second pilot on said four-way valve which re-opens said normally open Humphrey valve.

5. A pneumatic method for sensing movement of an article, as in claim 4, wherein the line pressure signal received is reduced to 5–10 psi to operate the proximity switch sensor.

6. A pneumatic method for sensing movement of an article as in claim 4, wherein the mechanical means for sensing movement of an article comprises the step of rotating a sensing arm by the force of the movement of said article, thereby closing off the exhaust port of a proximity switch sensor.

* * * * *